US008899139B2

(12) United States Patent
Brill et al.

(10) Patent No.: US 8,899,139 B2
(45) Date of Patent: Dec. 2, 2014

(54) EXPLOSIVE DEVICE DISRUPTOR SYSTEM WITH SELF CONTAINED LAUNCHER CARTRIDGES

(76) Inventors: Johnathan M. Brill, Oxnard, CA (US); Howard D. Kent, Simi Valley, CA (US); Randolph J. Brill, Oxnard, CA (US)

( * ) Notice: Subject to any disclaimer, the term of this patent is extended or adjusted under 35 U.S.C. 154(b) by 19 days.

(21) Appl. No.: 13/619,182

(22) Filed: Sep. 14, 2012

(65) Prior Publication Data

US 2014/0076133 A1 Mar. 20, 2014

(51) Int. Cl.
*F41F 1/08* (2006.01)
*F42B 5/08* (2006.01)

(52) U.S. Cl.
USPC ..... 89/1.41; 102/436

(58) Field of Classification Search
CPC ..... F41A 9/35; F41A 7/08; F41A 19/68; F41A 3/60; F41A 19/18; F41A 19/183; F41A 21/06; F41A 19/69
USPC ..... 89/1.41, 37.13, 17–18, 1.34, 126; 42/10, 84, 42.02, 105; 102/346, 357, 102/439, 469
See application file for complete search history.

(56) References Cited

U.S. PATENT DOCUMENTS

| | | | | | |
|---|---|---|---|---|---|
| 1,741,901 | A | * | 12/1929 | Alden | 102/436 |
| 3,643,545 | A | * | 2/1972 | Nahas | 89/1.3 |
| 4,012,985 | A | * | 3/1977 | Magnusson | 89/1.818 |
| 4,222,306 | A | * | 9/1980 | Maury | 89/1.41 |
| 4,635,526 | A | * | 1/1987 | Mottana et al. | 89/1.41 |
| 4,912,869 | A | * | 4/1990 | Govett | 42/105 |
| 5,983,551 | A | * | 11/1999 | Lalor | 42/105 |
| 6,237,273 | B1 | * | 5/2001 | La Mura et al. | 42/84 |
| 6,381,894 | B1 | * | 5/2002 | Murphy | 42/77 |

* cited by examiner

*Primary Examiner* — Daniel J Troy
*Assistant Examiner* — John D Cooper
(74) *Attorney, Agent, or Firm* — Parsons & Goltry; Robert A. Parsons; Michael W. Goltry

(57) ABSTRACT

A disruptor system includes a plurality of launcher cartridges each including a casing having a closed rearward end and an open forward end defining a cavity. A propellant and payload are carried within the cavity proximate the rearward end. A mounting base is included, having a breach portion defining a back surface and a plurality of barrel portions terminating at a forward end. Each barrel portion defines a bore, the bore open at the forward end. Each bore receives one of the plurality of launcher cartridges. A firing mechanism is coupled to each of the plurality of cartridges.

15 Claims, 6 Drawing Sheets

EXPLOSIVE DEVICE DISRUPTOR SYSTEM WITH SELF CONTAINED LAUNCHER CARTRIDGES

FIELD OF THE INVENTION

This invention relates to explosive ordnance disposal.

More particularly, the present invention relates to devices for disrupting explosive ordnance.

BACKGROUND OF THE INVENTION

Disruptor devices are well known and have been used, in various forms, in many and varied situations where an explosive device needs to be cleared. Technology for disrupting explosive ordnance such as military explosive devices or improvised explosive devices has evolved from the use of rifle fire to cause detonation, to disruptor cannon designed to blast the mechanism of the explosive device apart, causing deflagration or detonation. Currently, disruptor cannon devices are single shot projectors used for disrupting suspect packages or other ordnance. These disruptor cannon are typically designed with a heavy steel construction required by the pressures and velocities generated by the ammunition used and to help absorb recoil forces.

While useful in clearing an explosive device, current disruptor cannon are limited by their single shot construction. When multiple shots are required, a single disruptor cannon must be reloaded and repositioned. Often, disruptor cannon are mounted on remotely controlled robotic devices. The robot is run into position and the disruptor is fired. If additional shots are required, the robot must be returned for reloading and then repositioned for a second shot. This takes time, which time may be available in civilian scenarios but may not be available in a military environment. In a combat situation, where operators may be under fire in a complex ambush using rockets, machine guns and IEDs, time is typically short. Additionally, a disruptor is often used as a breaching tool to gain access to a space or area. If an explosive device is positioned within this area, once access is obtained, reloading the device is required to then disrupt the explosive device.

It would be highly advantageous, therefore, to remedy the foregoing and other deficiencies inherent in the prior art.

An object of the present invention is to provide a disruptor system with multiple shot capabilities.

Another object of the present invention is to provide a disruptor system for remote firing of cartridges.

Yet another object of the present invention is to provide a disruptor system capable of being employed for a variety of missions using a variety of cartridge types.

SUMMARY OF THE INVENTION

Briefly, to achieve the desired objects and advantages of the instant invention, provided is a disruptor system. The disruptor system includes a mounting base defining a plurality of bores, a launcher cartridge removable received in each of the plurality of bores, and a firing mechanism coupled to each of the plurality of cartridges.

In a specific aspect, the mounting base of the disruptor system includes a breach portion defining a rearward surface, and a plurality of barrel portions extending from the breach portion and terminating in a forward end of the mounting base. Each bore of the plurality of bores is defined by the plurality of barrel portions and is open at the forward end of the mounting base.

In yet more specific aspects, the bores defined by the plurality of barrel portions can have axis that are parallel, divergent from one another or the plurality of barrel portions are independently adjustable so that each bore defined thereby has an axis that can be independently altered relative adjacent bores.

In another aspect, the launcher cartridges of the disruptor system include a casing defining a chamber and having a butt end, side walls extending from the butt end and terminating at a muzzle end. A propellant, ignited by the firing mechanism, is packed within the chamber at the butt end. A wad is positioned within the chamber, packed against the propellant, and a payload is carried within the chamber and separated from the propellant by the wad.

The firing mechanism includes one of fuses and electrical leads, for igniting the propellant, extending from the casing of the cartridge and coupled to a remote initiator. The firing mechanism can also include electrical contacts carried by the cartridge casing conductively engaging complemental contacts carried by the mounting base within each bore. The complemental contacts are carried by the mounting base conductively coupled to a remote initiator.

In yet another aspect, the casing includes an integral barrel section which extends from adjacent the payload to the muzzle end. The integral barrel section extends beyond the forward end of the barrel portions.

In yet a further aspect, a groove is formed circumferentially around the casing of the cartridge proximate to and spaced from the butt end as part of a locking mechanism which holds the cartridges in a locked and unlocked configuration. The locking mechanism includes at least one aperture extending through the mounting base perpendicularly to and tangentially across each of the bores. The at least one aperture for each bore is positioned such that the grooves of the cartridges carried by the bores falls on the tangent and is in communicate with the apertures in the unlocked configuration. A locking pin is inserted concurrently through each aperture and the grooves in the locked configuration, preventing longitudinal movement of the cartridges within the bores.

BRIEF DESCRIPTION OF THE DRAWINGS

Further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
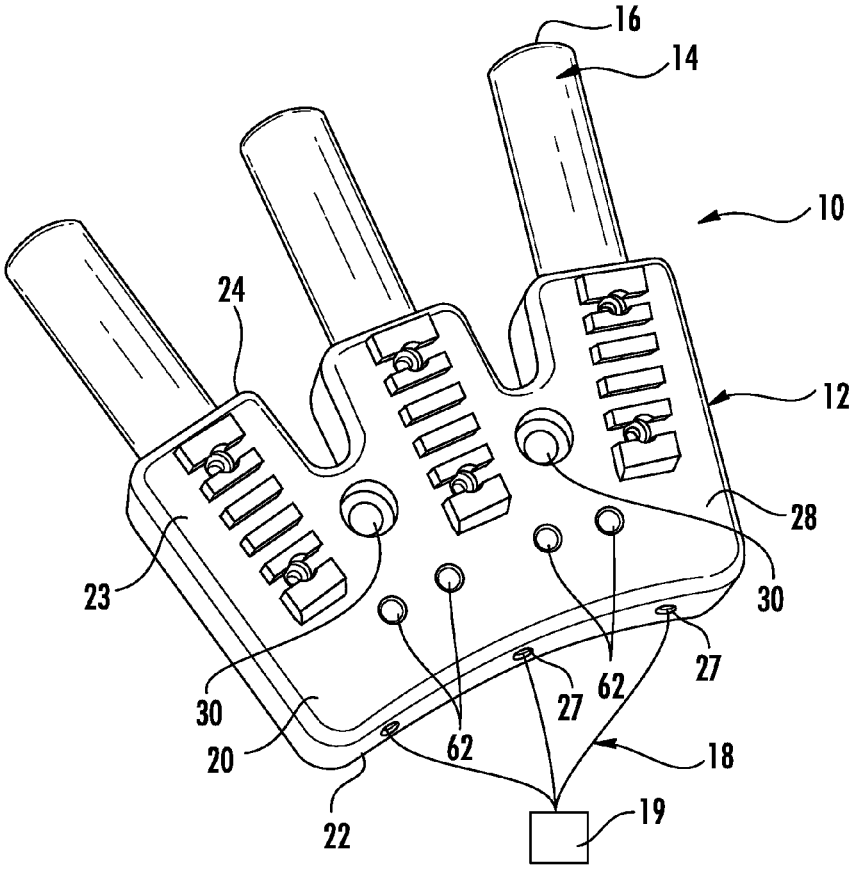
FIG. 1 is a top perspective view of a disruptor system according to the present invention.
Figure 2:
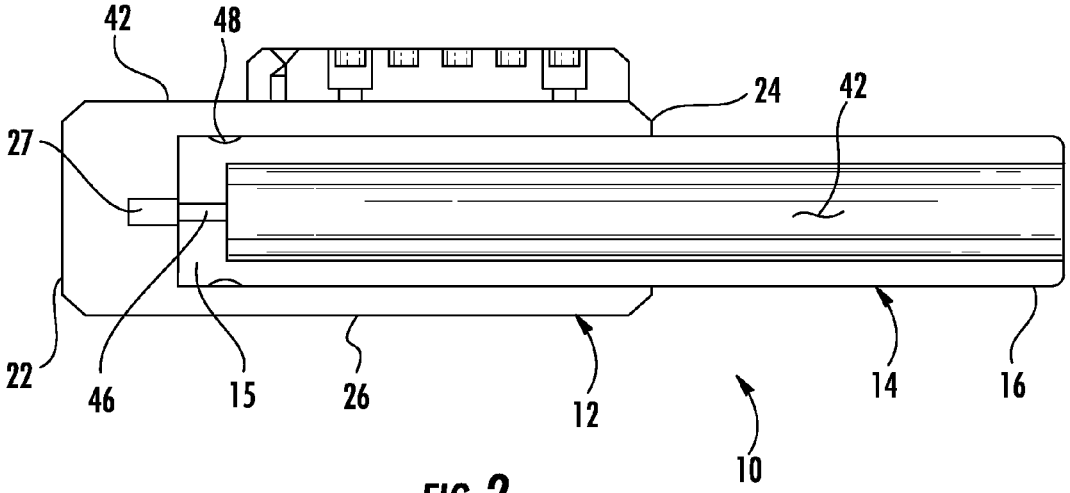
FIG. 2 is a sectional side view of the disruptor system of FIG. 1.

Turning now to the drawings in which like reference characters indicate corresponding elements throughout the several views, attention is directed to FIGS. 1 and 2 which illustrate a disruptor system generally designated 10. Disruptor system 10 includes a mounting base 12, launcher cartridges 14 having a rearward end 15 and a forward end 16, carried by mounting base 12, and a firing mechanism 18 coupled to a firing control system 19. Mounting base 12 receives cartridges 14 and supports and positions them for remote firing to disrupt explosive charges, breach obstacles, and numerous other missions which will be described presently.

Figure 3:
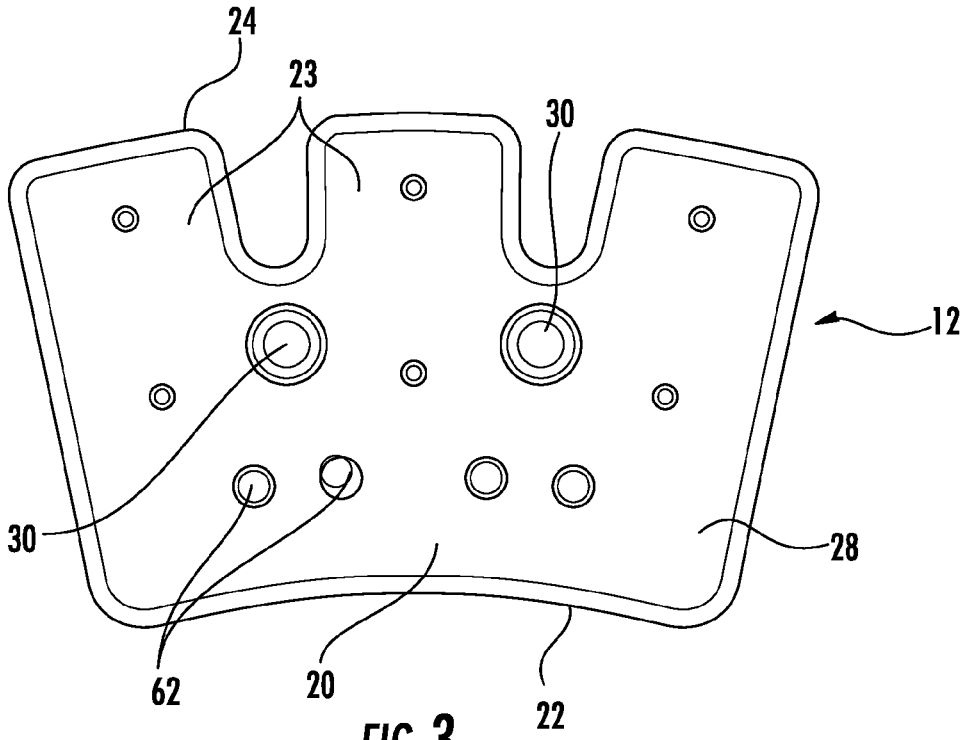
FIG. 3 is a top plan view of the mounting base of the disruptor system of FIG. 1.
Figure 4:
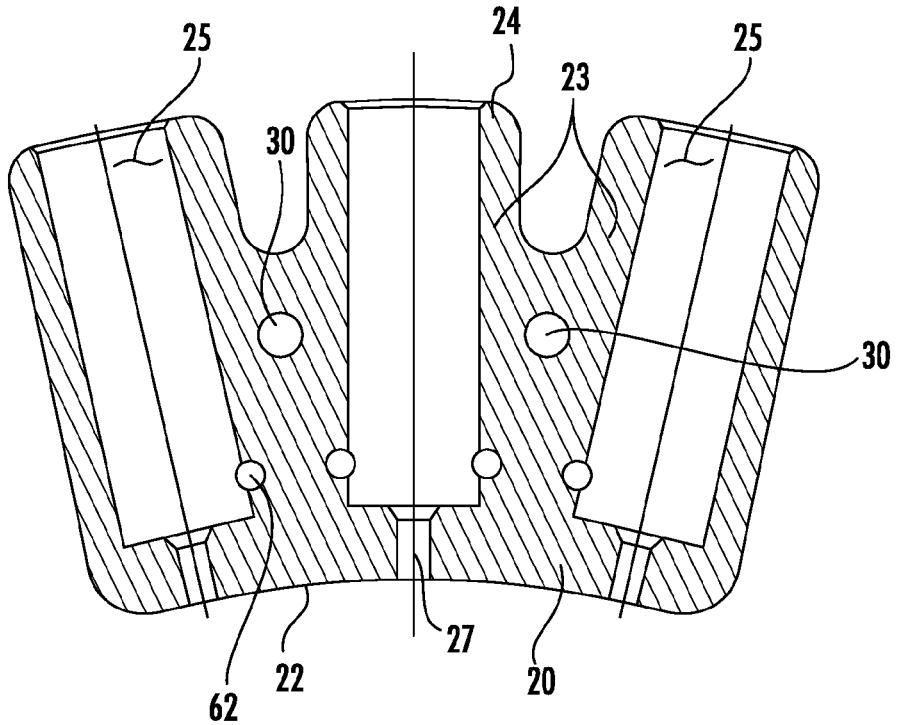
FIG. 4 is a sectional top view of the mounting base of the disruptor system.

With Additional reference to FIGS. 3 and 4, mounting base 12 includes a breach portion 20 defining a rearward surface 22 of mounting base 12, and a plurality of barrel portions 23 extending from breach portion 20 and terminating in a forward end 24 of mounting base 12. Breach portion 20 and barrel portions 22 define a plurality of bores 25, each bore 25 open at forward end 24 for receiving rearward end 15 of a cartridge 14. In the preferred embodiment, breach portion 20 includes ignition apertures 27 extending therethrough, an ignition aperture 27 aligned with and in communication with each of bores 25. Mounting base 12 further includes a bottom surface 26 and a top surface 28. In the present embodiment, while each of bores 25 is dispersed at an angle of approximately 12 degrees from adjacent bores 25, the angle can be increased or decreased as desired. Thus, multiple parallel bores can be provided, or the bores can be presented at a variety of angles to provide a desired spread.

Figure 5:
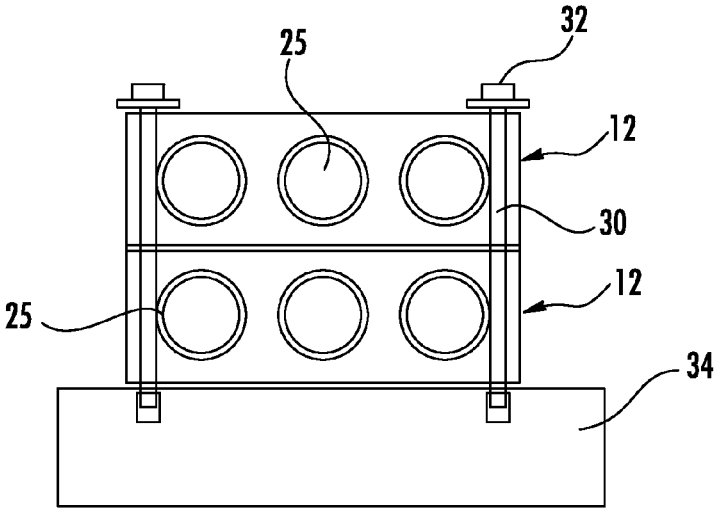
FIG. 5 is a front elevation view of stacked mounting bases attached to a support.

Mounting base 12 further includes attachment points wherein fasteners are employed to attach mounting base 12 to fixed installations, vehicle hulls, remote firing platforms, weapons pintles, yokes or firing mounts, robots and the like. In the preferred embodiment, apertures 30 extend through mounting base 12 from top surface 28 to bottom surface 26. With additional reference to FIG. 5, fasteners 32 extend through apertures 30 and engage a supporting surface 34. Still referring to FIG. 5, it can be seen that multiple mounting bases 12 can be stacked to provide additional bores 25 for cartridges 14, allowing more shots before reloading is required. It will be understood that multiple or different attachment points can be used to permit attachment to many and varied structures as enumerated previously.

Figure 6:
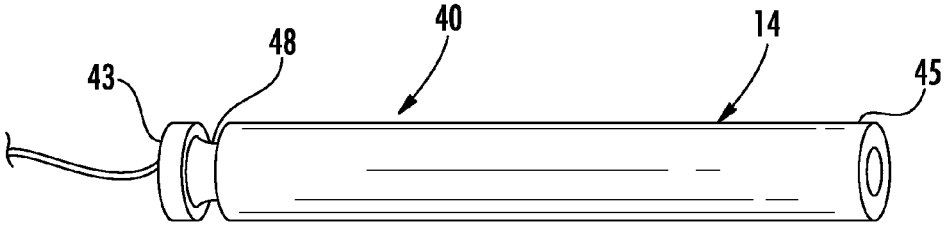
FIG. 6 is a side perspective view of a launcher cartridge.
Figure 7:
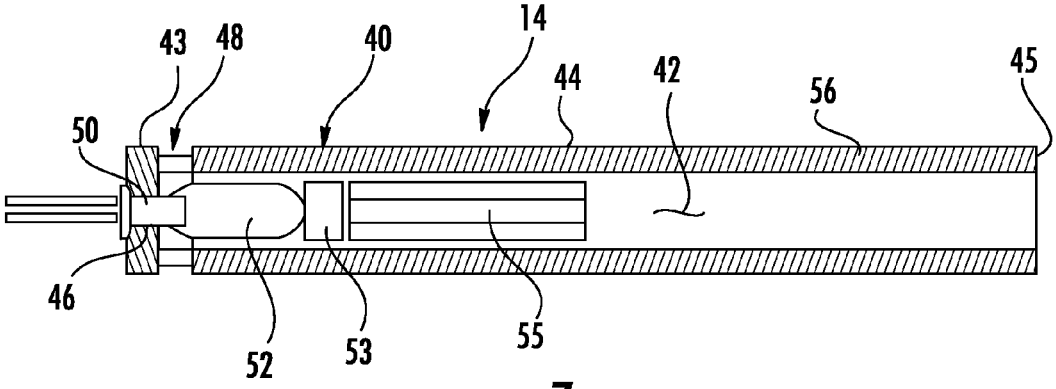
FIG. 7 is a sectional side view of the launcher cartridge of FIG. 6

Turning now to FIGS. 6 and 7, a launcher cartridge 14 is illustrated. Cartridge 14 is a self-contained disruptor which can be single shot disposable or reloadable. Cartridge 14 includes an aluminum casing 40 defining a chamber 42 and having a butt end 43, side walls 44 extending from butt end 43 and terminating at a muzzle end 45. In this embodiment, butt end 43 includes a central aperture 46 from which firing mechanism components extend. However, as will be described subsequently, a central aperture may be omitted when electrical contacts are employed. A groove 48 is formed circumferentially around casing 40 proximate to but spaced from butt end 43. In an electrically initiated cartridge, cartridge 14 further includes a primer 50 positioned in central aperture 46 with electrical leads 51 extending back through aperture (FIG. 1). and extending into chamber 42 at butt end 43 to ignite a propellant 52. Propellant 52 is packed within chamber 42 at butt end 43 adjacent to and in communication with primer 50. It should be understood that any ignition mechanism can be employed, such as percussion primers, fuses, wires, spark or arc igniters, heat or chemical reactions, and the like. A wad 53 is positioned within chamber 42, packed against propellant 52 and separating a payload 55 therefrom. Payload 55 is packed against wad 53 and can be one of a number of different payloads types depending upon the mission to be accomplished. Payload 55 can include armor piercing bullets, compressed clay or copper projectiles, hole cutting hollow point projectiles or hydraulic charges when the mission is explosive ordnance disposal. Payloads for other missions such as breaching uses, riot control and non-lethal force uses, and for lethal force uses include blanks, full-bore or sub-caliber sabot fired projectiles, slugs, multiple pellets of various sizes, ceramic or metallic frangible slugs or shot, hardened frangible slugs or shot, armor piercing, hollow point metallic, clay frangible, incendiary, explosive or shaped charge, beans bags such as pellet or powder filled, sponge or rubber projectiles or pellets, foam tipped, cargo rounds, muzzle blast rounds containing powdered riot and/or liquid riot and/or dye marking agents, irritants, smoke, muzzle blast or projected bursting distraction projectiles, flechettes, flares or signaling devices, and the like. Cartridges 14 can also be designed to fire subsonic antipersonnel anti-material or armor piercing projectiles designed to be used with sound or firing signature suppressors. As can be seen, casing 40 includes an integral barrel section 56 which extends from payload 55 to muzzle end 45. Integral barrel portion extends beyond forward end 24 of barrel portions 23. Integral barrel section 56 can be smooth bore or rifled, again depending upon the payload and mission to be accomplished. Since cartridges 14 are self contained, each cartridge can be replaced with a cartridge for a different mission easily and quickly. Additionally, since mounting base 12 holds multiple cartridges 14, a load of cartridges 14 can be designed to cover different contingencies in a particular mission.

Figure 8A:
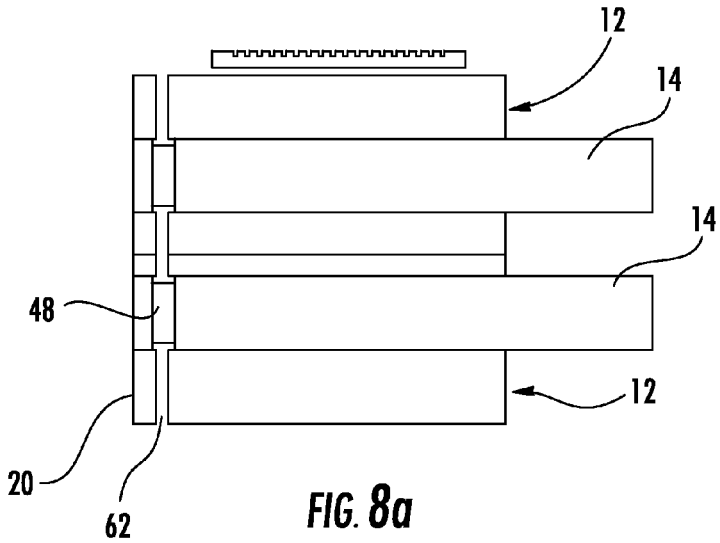
FIG. 8*a* is a sectional side view of stacked mounting bases in an unlocked configuration.
Figure 8C:
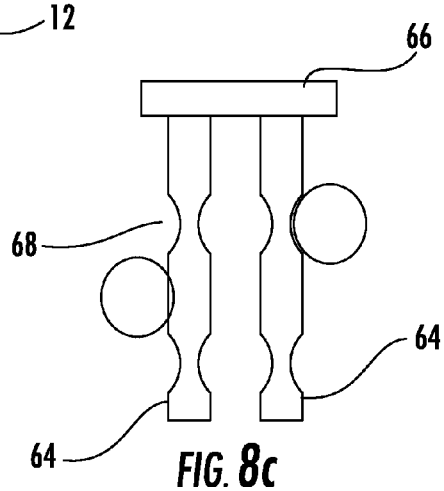
FIG. 8*c* is a side view of a locking bar with locking pins.
Figure 8B:
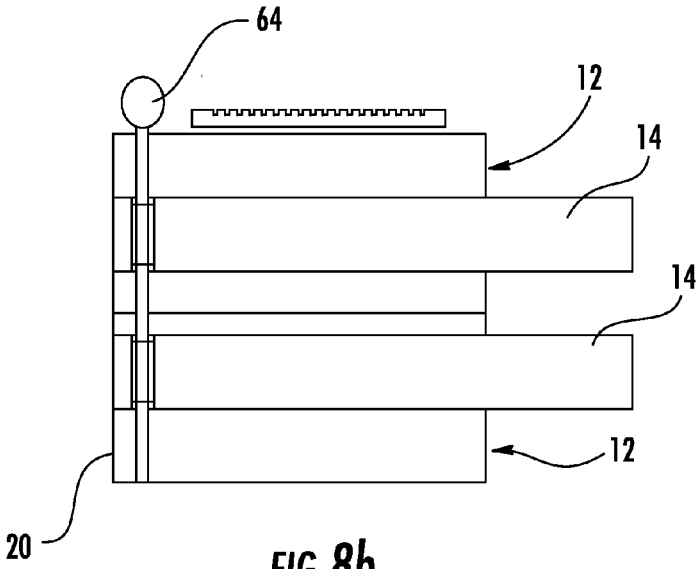
FIG. 8*b* is a sectional side view of stacked mounting bases in a locked configuration.

Mounting base 12 can hold cartridges 14 in a locked or unlocked configuration. In the embodiment illustrated in FIGS. 1-4, breach portion 20 is closed behind cartridges 14 except for ignition aperture 27 and it is therefore possible that the cartridge can remain unlocked. However, it is preferred that a locking mechanism be employed. Referring back to FIGS. 1, 3, and 4, with additional reference to FIGS. 8*a*, 8*b* and 8*c*, mounting base 12 can include a locking mechanism 60 including apertures 62 extending from top surface 28 to bottom surface 26, and passing through a tangent of bores 25. Each bore 25 has at least one aperture forming a tangent thereof. A locking pin 64 removable extends through each aperture 62. While FIGS. 8*a*, 8*b*, and 8*c* illustrate a mounting base 12 having an open breach configuration, thereby requiring a locking mechanism, the locking mechanism is the same for open breach or closed breach embodiments. Additionally, stacked mounting bases 12 are illustrated to show alignment of apertures 62 to allow use of one locking pin 64 per aperture 62 even when multiple mounting bases 12 are employed.

With specific reference to FIGS. 8*a* and 8*b*, mounting bases 12 are stacked to provide additional cartridge holding capability. Mounting bases 12 are stacked to align apertures 62. As can be seen, apertures 62 extend perpendicularly to and tangentially across bores 25 such that when cartridges 14 are positioned within bores 25, grooves 48 fall on the tangent and communicate with apertures 62 in the unlocked configuration (FIG. 8*a*). Upon inserting locking pins 64 into apertures 62, locking pins 64 pass concurrently through apertures 62 and grooves 48 (FIG. 8*b*), placing mounting base 12 in the locked configuration, preventing longitudinal movement of cartridges 14 within bores 25. Locking pins 64 can be of uniform diameter and completely removed or inserted to place mounting base 12 in the unlocked and locked configurations, respectively, or locking pins 64 can have spaced notches as shown in FIG. 8*c*. In this instance, pins 64 are joined by a locking bar 66 coupled to one end, and notches 68 are formed along the length of pin 64. Locking pins 64 are fully inserted and partially retracted by movement of locking bar 66. When fully inserted, locking pins 64 occupy grooves 48 of cartridges 14, locking them in place. When partially withdrawn, notches 68 align with grooves 48, allowing longitudinal movement of cartridges 14.

Referring now to FIGS. 1 and 2, various accessories can be used in conjunction with mounting base 12. Accessories can be attached to mounting base 12 using a rail 70 coupled to top surface 28 in axial alignment with each of bores 25 and cartridges 14. A plurality of threaded apertures is formed in top surface 28 of barrel portion 23 above each bore 25. A rail system, such as a Picatinny type rail 70 is coupled to upper surface 28 using fasteners extending through rail 70 and threading into threaded apertures 62. Rails 70 can receive numerous accessories like aiming devices such as cameras, lights, weapons sights, laser projectors, rangefinders and the like. In this manner the projectiles carried by cartridges 14 can be aimed remotely, manually or the like.

Figure 9B:
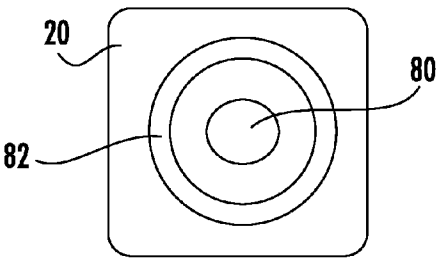
FIG. 9*b* is an enlarged end view of the breach plate contacts of the firing mechanism of FIG. 9*a;*
Figure 9C:
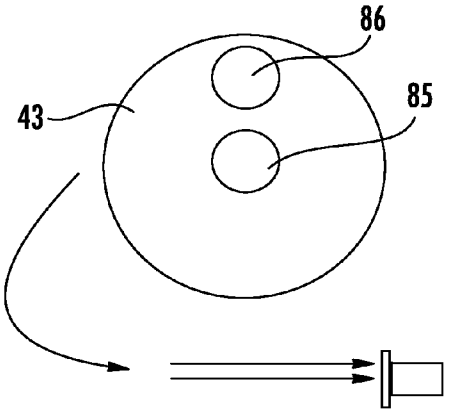
FIG. 9*c* is an enlarged end view of the cartridge contacts of the firing mechanism of FIG. 9*a*.
Figure 9A:
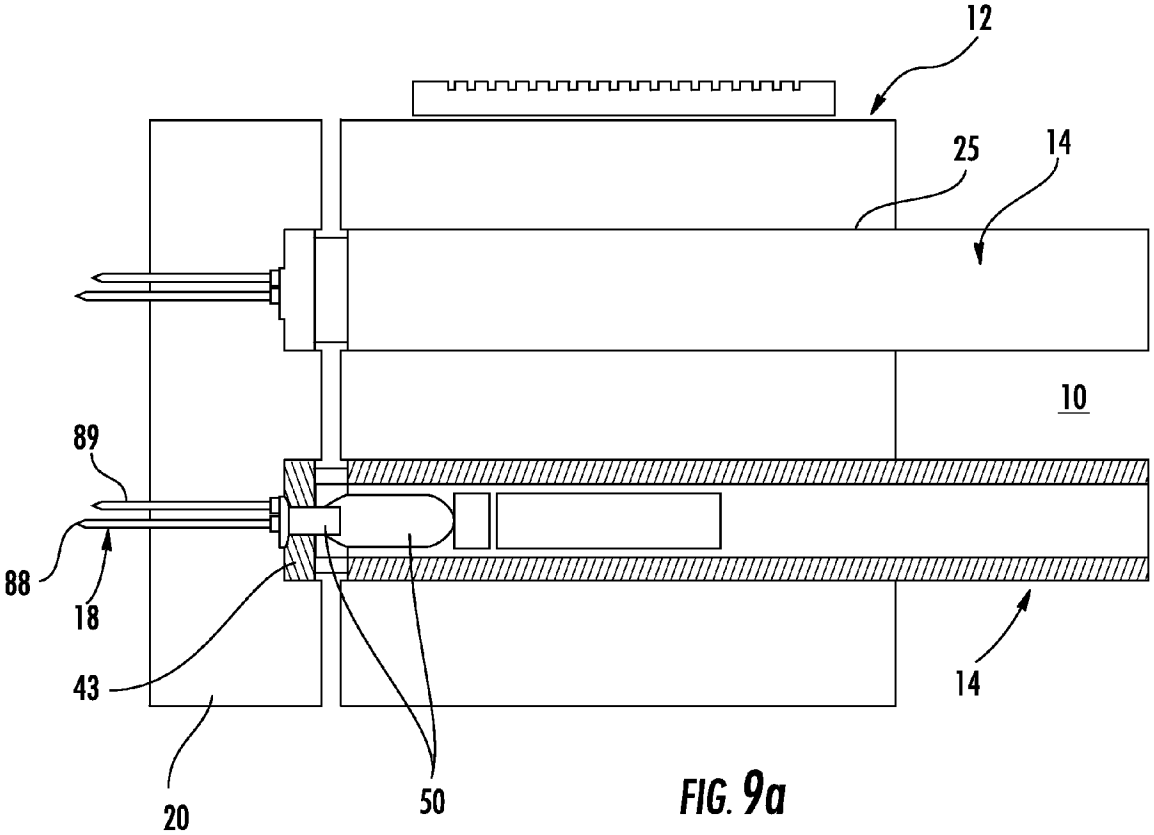
FIG. 9*a* is a sectional side view of stacked mounting bases in an unlocked configuration with an electrical firing mechanism.

Referring now to FIGS. 9*a*, 9*b* and 9*c*, another type of firing mechanism 18 is illustrated. In this embodiment, breach portion 20 is closed and cartridge 14 is positioned with end 43 in abutting contact. Breach portion 20 includes an inner center contact 80 and an outer ring contact 82 within bores 25. Butt end 43 of cartridge 14 includes an electrically fired primer 50 coupled to a central contact 85 and a peripheral contact 86. When cartridge 14 is positioned within bore 25, central contact 85 conductively engages center contact 80 and peripheral contact 86 conductively contacts outer ring contact 82. Since outer ring contact 82 is a ring encircling center contact 80, rotational orientation of cartridge 14 within bore 25 is irrelevant to contact being made. Leads 88 and 89 extend from contacts 80 and 82, and coupled to fire control system 19. It should be understood that firing mechanisms can include cannon fuse which ignite the propellant, wires or contacts which lead to electrically fired initiators, pin fired devices for initiating primer caps and the like. Disruptor system 10 may or may not include a computer firing control system 19, safe/armed sub-system and the like.

Figure 10:
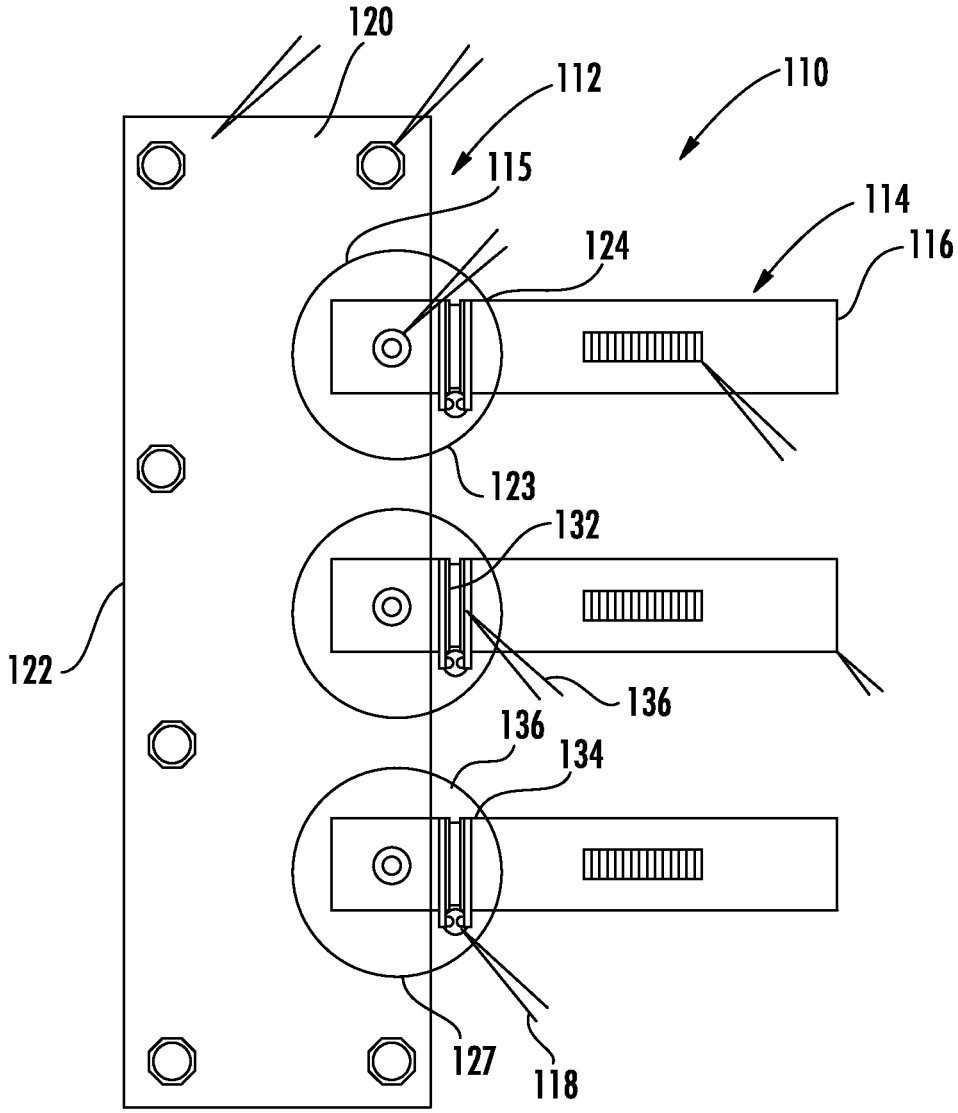
FIG. 10 is a top view of a disruptor system according to the present invention with a mounting base having adjustable barrel portions.

Turning now to FIG. 10, a disruptor system generally designated 110 is illustrated. Disruptor system 110 includes a mounting base 112, launcher cartridges 114 having a rearward end 115 and a forward end 116, carried by mounting base 112, and a firing mechanism 118. Mounting base 112 receives cartridges 114 and supports and positions them for remote firing to disrupt explosive charges, breach obstacles, and numerous other missions which will be described presently. Mounting base 112 includes a breach portion 120 defining a rearward surface 122 of mounting base 112, and a plurality of barrel portions 123 extending from breach portion 120 and terminating in a forward end 124 of mounting base 112. Breach portion 120 and barrel portions 124 define a plurality of bores 125, each bore 125 open at forward end 124 for receiving rearward end 115 of a cartridge 114. In this preferred embodiment, breach portion 120 is closed but includes socket cavities 127 in which are received barrel portions 123. Barrel portions 123 have a generally round rearward end received in socket cavities 127. In this manner, barrel portions 123 can be adjusted independently to orient cartridges 112 in a desired direction independent of the adjacent barrel portions. In this embodiment, firing mechanism 118 includes ring contacts 130 and 132 carried within bores 125 corresponding to ring contacts 134 and 136 carried encircling cartridge 114 proximate rearward end 115.

The disclosed disruptor system 10 can be used in missions other than explosive ordnance disposal, such as breaching missions. In this specific example, mounting base 12, carrying three cartridges 14 angled outwardly to provide a desired spread, is carried by the manipulator arm of a robotic vehicle. Cartridges 14 are loaded with overpressure distraction rounds wired through apertures 27 and triggered by the single firing circuit generally carried by robotic vehicles. The robotic vehicle is positioned adjacent a heavily reinforced door, possibly having multiple locks, that needs to be breached. A single trigger initiates discharge of all three cartridges aimed at separate areas on the door frame, quickly breaching the door without repeated reloading and positioning of the robotic vehicle. Another scenario includes a law enforcement vehicle, such as an armored car, carrying a disruptor system 10 including multiple mounting bases 12. Cartridges carried by mounting bases 12 would include riot control and non-lethal payloads.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A disruptor system comprising:

a mounting base defining a plurality of bores, the mounting base including:

a breach portion defining a rearward surface;

a plurality of barrel portions extending from the breach portion and terminating in a forward end of the mounting base; and each bore of the plurality of bores is defined by the plurality of barrel portions and is open at the forward end of the mounting base wherein the bores defined by the plurality of barrel portions have axis that are divergent from one another;

a launcher cartridge removable received in each of the plurality of bores, the launcher cartridges including:

a casing defining a chamber and having a butt end, side walls extending from the butt end and terminating at a muzzle end;

a propellant, ignited by the firing mechanism, packed within the chamber at the butt end;

a wad positioned within the chamber, packed against the propellant; and a payload carried within the chamber and separated from the propellant by the wad; and a firing mechanism coupled to each of the plurality of cartridges.

2. A disruptor system as claimed in claim 1 wherein the plurality of barrel portions are independently adjustable so that each bore defined thereby has an axis that can be independently altered relative adjacent bores.

3. A disruptor system as claimed in claim 1 wherein the firing mechanism includes one of fuses and electrical leads, for igniting the propellant, extending from the casing of the cartridge and coupled to a remote initiator.

4. A disruptor system as claimed in claim 1 wherein the firing mechanism includes electrical contacts carried by the cartridge casing conductively engaging complemental contacts carried by the mounting base within each bore, the complemental contacts carried by the mounting base conductively coupled to a remote initiator.

5. A disruptor system as claimed in claim 1 wherein the casing further includes an integral barrel section which extends from adjacent the payload to the muzzle end, the integral barrel section extending beyond the forward end of the barrel portions.

6. A disruptor system comprising:

a mounting base defining a plurality of bores, the mounting base including:

a breach portion defining a rearward surface;

a plurality of barrel portions extending from the breach portion and terminating in a forward end of the mounting base; and each bore of the plurality of bores is defined by the plurality of barrel portions and is open at the forward end of the mounting base;

a launcher cartridge removable received in each of the plurality of bores, the launcher cartridge including:

a casing defining a chamber and having a butt end, side walls extending from the butt end and terminating at a muzzle end, and a groove formed circumferentially around the casing proximate to and spaced from the butt end;

a propellant, ignited by the firing mechanism, packed within the chamber at the butt end;

a wad positioned within the chamber, packed against the propellant; and a payload carried within the chamber and separated from the propellant by the wad; and a firing mechanism coupled to each of the plurality of cartridges.

7. A disruptor system as claimed in claim 6 further comprising a locking mechanism which holds the cartridges in a locked and unlocked configuration, the locking mechanism including:

at least one aperture extending through the mounting base perpendicularly to and tangentially across each of the bores; and the at least one aperture for each bore positioned such that the grooves of the cartridges carried by the bores falls on the tangent and is in communicate with the apertures in the unlocked configuration; and a locking pin inserted concurrently through each aperture and the grooves in the locked configuration, preventing longitudinal movement of the cartridges within the bores.

8. A disruptor system comprising:

a plurality of launcher cartridges each including a casing having a closed rearward end and an open forward end defining a cavity, a propellant carried within the cavity proximate the rearward end and a payload;

a mounting base including a breach portion defining a back surface and a plurality of barrel portions terminating at a forward end, each barrel portion defining a bore, the bore open at the forward end, each bore receiving one of the plurality of launcher cartridges through the open forward end;

the casing further includes an integral barrel section which extends from adjacent the payload to the open forward end, the integral barrel section extending beyond the forward end of the barrel portions; and a firing mechanism coupled to each of the plurality of cartridges.

9. A disruptor system as claimed in claim 8 wherein the bores defined by the plurality of barrel portions have axis that are parallel.

10. A disruptor system as claimed in claim 8 wherein the bores defined by the plurality of barrel portions have axis that are divergent from one another.

11. A disruptor system as claimed in claim 8 wherein the plurality of barrel portions are independently adjustable so that each bore defined thereby has an axis that can be independently altered relative adjacent bores.

12. A disruptor system as claimed in claim 8 wherein the firing mechanism includes one of fuses and electrical leads, for igniting the propellant, extending from the casing of the cartridge and coupled to a remote initiator.

13. A disruptor system as claimed in claim 8 wherein the firing mechanism includes electrical contacts carried by the cartridge casing conductively engaging complemental contacts carried by the mounting base within each bore, the complemental contacts carried by the mounting base conductively coupled to a remote initiator.

14. A disruptor system as claimed in claim 8 further including a groove formed circumferentially around the casing proximate to and spaced from the rearward end.

15. A disruptor system as claimed in claim 14 further comprising a locking mechanism which holds the cartridges in a locked and unlocked configuration, the locking mechanism including:

at least one aperture extending through the mounting base perpendicularly to and tangentially across each of the bores; and the at least one aperture for each bore positioned such that the grooves of the cartridges carried by the bores falls on the tangent and is in communicate with the apertures in the unlocked configuration; and a locking pin inserted concurrently through each aperture and the grooves in the locked configuration, preventing longitudinal movement of the cartridges within the bores.

* * * * *